US006722067B1

(12) United States Patent
Kennedy et al.

(10) Patent No.: US 6,722,067 B1
(45) Date of Patent: Apr. 20, 2004

(54) SIGN HOLDER

(75) Inventors: Robert D. Kennedy, Downingtown, PA (US); A. Joe Benjamin, West Chester, PA (US); William B. Miller, Ambler, PA (US); N. Bruce Unruh, West Chester, PA (US)

(73) Assignee: Signage Resources, LLC, Eagle, PA (US)

( * ) Notice: Subject to any disclaimer, the term of this patent is extended or adjusted under 35 U.S.C. 154(b) by 56 days.

(21) Appl. No.: 09/981,482

(22) Filed: Oct. 16, 2001

(51) Int. Cl.[7] ..... G09F 15/00

(52) U.S. Cl. ..... 40/606.19; 40/606.01; 40/607.05

(58) Field of Search ..... 40/645, 661.11, 40/752, 777, 778, FOR 159.1, 606, 611, 606.19, 606.01, 607.01, 607.05, 607.09

(56) References Cited

U.S. PATENT DOCUMENTS

| | | | | | |
|---|---|---|---|---|---|
| 993,674 | A | * | 5/1911 | Freeman | 40/611 |
| 1,358,000 | A | * | 11/1920 | Kruschke | 40/606 |
| 1,822,787 | A | * | 9/1931 | Slawson | 40/645 |
| 2,639,524 | A | * | 5/1953 | Irving | 40/645 |
| 2,844,900 | A | * | 7/1958 | Miller | 40/778 |
| 4,016,664 | A | * | 4/1977 | Kaufmann | 40/778 X |
| 4,304,059 | A | * | 12/1981 | Tisbo et al. | 40/645 |
| 4,322,905 | A | * | 4/1982 | Kruse | 40/606 |
| 4,831,760 | A | * | 5/1989 | Walker | 40/606 X |
| 4,954,083 | A | * | 9/1990 | Leff et al. | 40/611 X |
| 5,826,358 | A | * | 10/1998 | DeSutter | 40/611 |
| 6,119,386 | A | * | 9/2000 | Henry et al. | 40/778 X |

OTHER PUBLICATIONS

"Dunbar Tee Signs," Detailed product information, http://www.dunbarteesigns.com/product.shtml, 1999, 5 pages.

* cited by examiner

*Primary Examiner*—Joanne Silbermann
(74) *Attorney, Agent, or Firm*—Woodcock Washburn LLP

(57) ABSTRACT

Sign holders are provided for displaying sign inserts. The sign holders are capable of being reused, whereby several different signs can be removably affixed to the sign holders for displaying signs at multiple events. Signage systems are also provided, comprising a plurality of sign holders and an optional container for storing and transporting the same.

14 Claims, 4 Drawing Sheets

SIGN HOLDER

FIELD OF THE INVENTION

The present invention is directed to sign holders and signage systems using the same. The sign holders are capable of being reused, whereby different media can be removably affixed to the sign holders for displaying varying information at multiple events.

BACKGROUND OF THE INVENTION

Signs and the information they contain are an important aspect of every person's daily life. They provide directions, recognition, and history lessons. Signs are also used to provide marketing-related information, such as for example a company name, phone number and contact person indicated on signs utilized in the real estate business. Signs have become a large part of special events, including for example, corporate and charity golf events, weddings and parties. The procedural and background information related to such events are typically foreign to its participants because of each event's uniqueness. Signs can therefore be used to make the participants feel at ease, as well as to lesson the burden on the organizers by eliminating the need to continually provide information orally.

Organizers of these special events have tended to use customized signs. However, customized signs generally cost more and have relatively short useful lives in view of the changing nature of the information to be displayed on the signs. For example, customized advertisement signs could become no longer useful due to a change in address or phone number of the establishment associated with the original sign.

Reusable sign holders that offer flexibility and an overall professional and pleasing appearance are disclosed herein. The sign holders are designed to hold sign inserts such that they can be reused many times for displaying different signs at multiple events. Event organizers can dramatically reduce their sign costs by either renting sign holders from facilities owning them and purchasing the sign inserts, or by purchasing the sign holders and reselling them after the event is over. Facilities owning sign holders of the present invention can accordingly use them as a profit generator by renting them, as part of their offering for using the facilities.

The sign holders described herein are particularly useful for golf events. The tremendous popularity of golf has led to the increasing use of golf facilities by charities for fund raising, and also by corporations for special events. The sign holders can be placed on each golf hole to display sign inserts projecting, for example, a hole sponsor or similarly related advertising. At the completion of the event, the signs can be removed from the sign holders and presented to sponsors or other participants as a memento of the event. The sign holders are preferably designed to provide multiple areas for the presentation of information to a viewer. These multiple information areas can include property ownership information or advertisements, leading to another means for using the sign holders as a profit generator.

SUMMARY OF THE INVENTION

In accordance with a preferred embodiment of the present invention, there has now been provided a sign holder comprising a support member including a front surface and a rear surface, and at least one recess in the front surface for receiving a sign. The recess has a bottom surface and sidewalls extending from the front surface to the bottom surface. In another embodiment, the sign holder may also include a handle extending from the support member, and an anchorage member coupled to the support member for maintaining the position of the sign holder after its initial placement.

In accordance with another embodiment of the present invention, there has now been provided a signage system for displaying signs at multiple events, comprising a plurality of portable and reusable sign holders and a plurality of signs corresponding to a first event that are removably affixed to the sign holders. Each of the sign holders includes a support member having a front surface and a rear surface, and at least one recess in said front surface for receiving a sign, said at least one recess having a bottom surface and sidewalls extending from said front surface to said bottom surface.

BRIEF DESCRIPTION OF THE DRAWINGS

The present invention is believed to be best understood through the following detailed description of preferred embodiments and the accompanying drawings wherein like reference numbers indicate like features, and wherein.

DETAILED DESCRIPTION OF THE PREFERRED EMBODIMENTS

Figure 1:
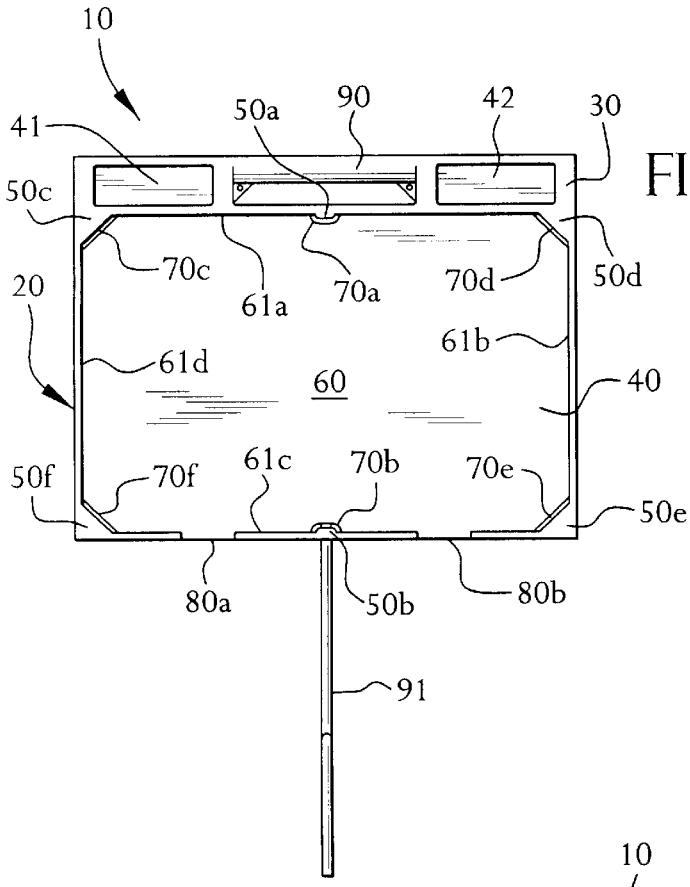
FIG. 1 is a front view of a sign holder provided by the present invention.
Figure 3:
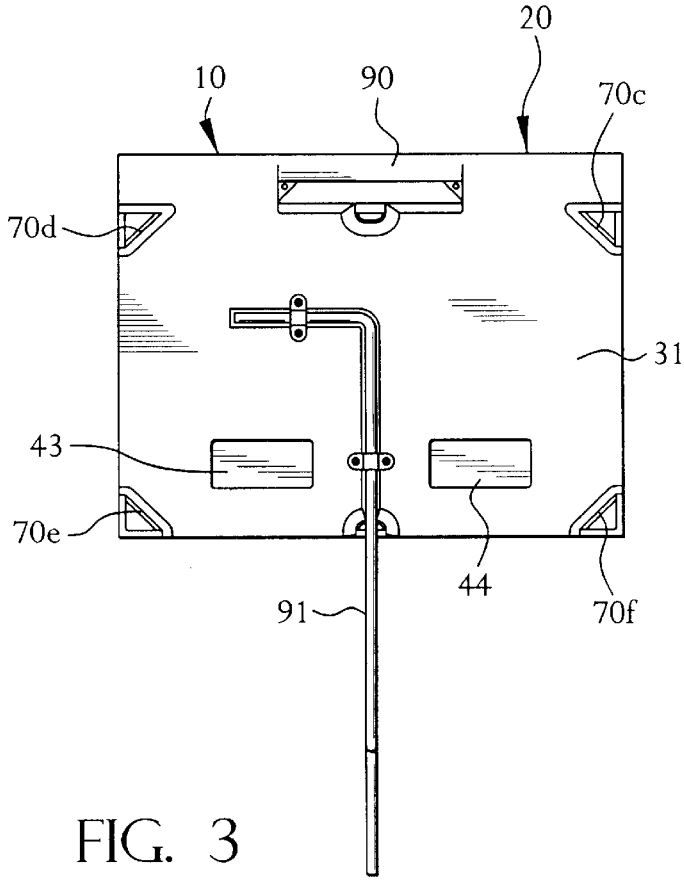
FIG. 3 is a rear view of the sign holder depicted in FIG. 1.
Figure 2:
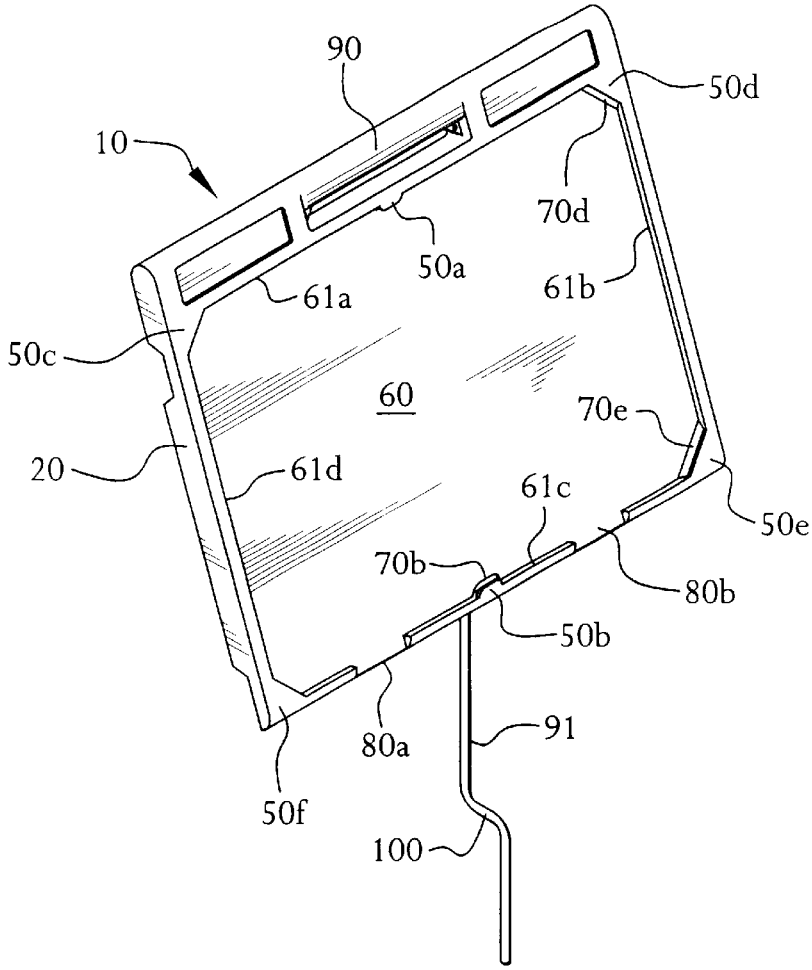
FIG. 2 is a perspective view of the sign holder depicted in FIG. 1.

Referring to FIGS. 1 to 3, sign holder 10 is shown with a support member 20 having front a surface 30 and a rear surface 31. Front surface 30 has a recess 40 spanning most of the front surface, and optional recesses 41 and 42. The recesses are provided for holding sign inserts. The recesses can vary in number, size and geometry in addition to what is depicted in the figures. Preferably, the recesses are sized and configured to accept standard paper sizes (for example, 11"×17" and 8½'×11"), such that signs can be printed on standard consumer printers. Much larger sized paper can also serve as the substrate for printing signs, which may be printed with architectural or engineering printers and plotters, or by commercial printers. Sign inserts may be laminated or covered by protectors, such as plastic sleeves, to protect the signs from the elements and to exhibit a professional appearance.

Rear surface 31 may optionally contain one or more recesses such as 43 and 44 shown in FIG. 3. Each of recesses 40–44 is defined by a bottom surface and sidewalls extending from the front (or rear) surface to the bottom surface. By way of example, recess 40 is shown having a bottom surface 60 and sidewalls 61*a*–61*d*.

The recesses and corresponding signs to be inserted therein can be dimensioned such that the signs are held through interference. The recesses can alternatively include structural elements for retaining the signs. Referring now to FIGS. 1 and 2, front surface 30 has tabs 50*a* and 50*b* for engaging top and bottom central portions of an inserted sign. Tabs 50*c*, 50*d*, 50*e* and 50*f* are located proximal the four corners of recess 40 for engaging like areas of an inserted sign. Further still, the signs may include pressure sensitive adhesive on one surface, which can either be coated directly thereon or carried by a tape or similar substrate and adhesive system. A suitable pressure sensitive adhesive is a styrenic block copolymer. The level of tack can be adjusted for varying sign weight and display conditions.

Apertures, such as 70*a*–70*f* shown in FIGS. 1 to 3, may be employed extending from the recess bottom surface. The apertures can provide improved sign insertion, particularly where the recess sidewalls are minimized, by permitting portions of the sign to extend into the apertures. The apertures may also be present to facilitate the formation of tabs 50 during manufacture of the sign holder. Apertures 70 are shown as substantially aligned with the overhanging tabs, such that the tabs cover at least a portion of the apertures.

In a preferred embodiment, at least one of the recess sidewalls has an opening whereby a portion of an inserted sign is accessible for facilitating the removal of the sign. FIGS. 1 and 2 illustrate sidewall 61*c* having two openings 80*a* and 80*b*. Openings 80 and apertures 70 provide the additional benefit of allowing rain and other precipitation, water, cleaning materials, and the like to drain from the recesses. Apertures 70 also provide air circulation to rear portions of inserted signs to decrease moisture build-up.

Support members 20 are preferably constructed from plastic, although other materials may be used, such as for example, corrugated paperboard, metal, and wood. Plastic support members are preferably made by blow molding techniques that are readily known and understood by those having ordinary skill in the art of forming goods through flow of thermoplastics. Injection molding techniques may also be used for forming the plastic support members. A representative, and non-limiting, list of suitable plastics includes polyethylene, propylene, polyester, and polyvinyl chloride.

As shown in the figures, sign holders 10 have a handle 90 and an anchorage member 91, both of which placement and removal of the support members. Each of these maneuver-enhancing features can either be integrally formed with the support member, or alternatively be manufactured as a separate component and thereafter coupled to the support member. As illustration, handle 90 is shown as integrally formed with the support member, while anchorage member 91 is separately formed and coupled to the rear surface of the support member by straps and screw fasteners.

The sign holders may be anchored in a plethora of environments, for example, in or on the ground, floating on water such as in a golf pond, or in the air. The anchorage member can accordingly assume many different configurations within the spirit and scope of the present invention. Preferably, anchorage member 91 is designed and configured to anchor the sign holder in the ground. In this manner, anchorage member 91 should be conducive to penetration into normal ground conditions and be able to hold the support member erect without falling over. Optional structural elements, such as threading or barbs, can be employed to facilitate ground penetration and retention, respectively. The anchorage member may be made from a flexible material, such as fiberglass or graphite, which is rigid enough to maintain the support member erect, yet flexible enough to withstand physical abuse without permanent damage. For example, the sign holder could be hit by a golf cart, flex upon impact, and then return to its original position once the golf cart has moved away; thereby resulting in fewer replacements and less re-positioning.

Anchorage member 91 is depicted in the figures as a stake, which can be driven into the ground. Weather-proofing the stake can be accomplished by painting the stake, or by constructing it from a material such as aluminum or galvanized steel. Anchorage member 91 is illustrated having a projection 100 that can be stepped on to help drive the anchorage member into the ground. Mallets or other similar devices can also be used to apply a normal force to the projection. Projection 100 is shown as right angle bend in an end region of the stake. One of ordinary skill in the art would readily appreciate numerous other means of providing the anchorage member with a projection capable of receiving a normal force.

Figure 4:
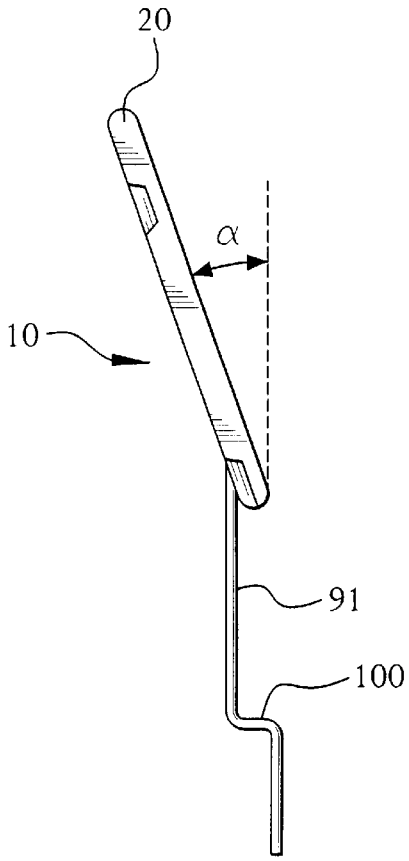
FIG. 4 is a side view of a sign holder provided by the present invention.

To better display signs attached to the sign holders, the support member can be angled relative to the anchorage member. FIG. 4 shows the support member positioned at an angle $\alpha$, which is preferably in the range of from about 5 degrees to about 45 degrees, and more preferably from about 15 degrees to about 30 degrees. One method of providing this feature is by bending an end region opposite to that comprising the projection.

Figure 5:
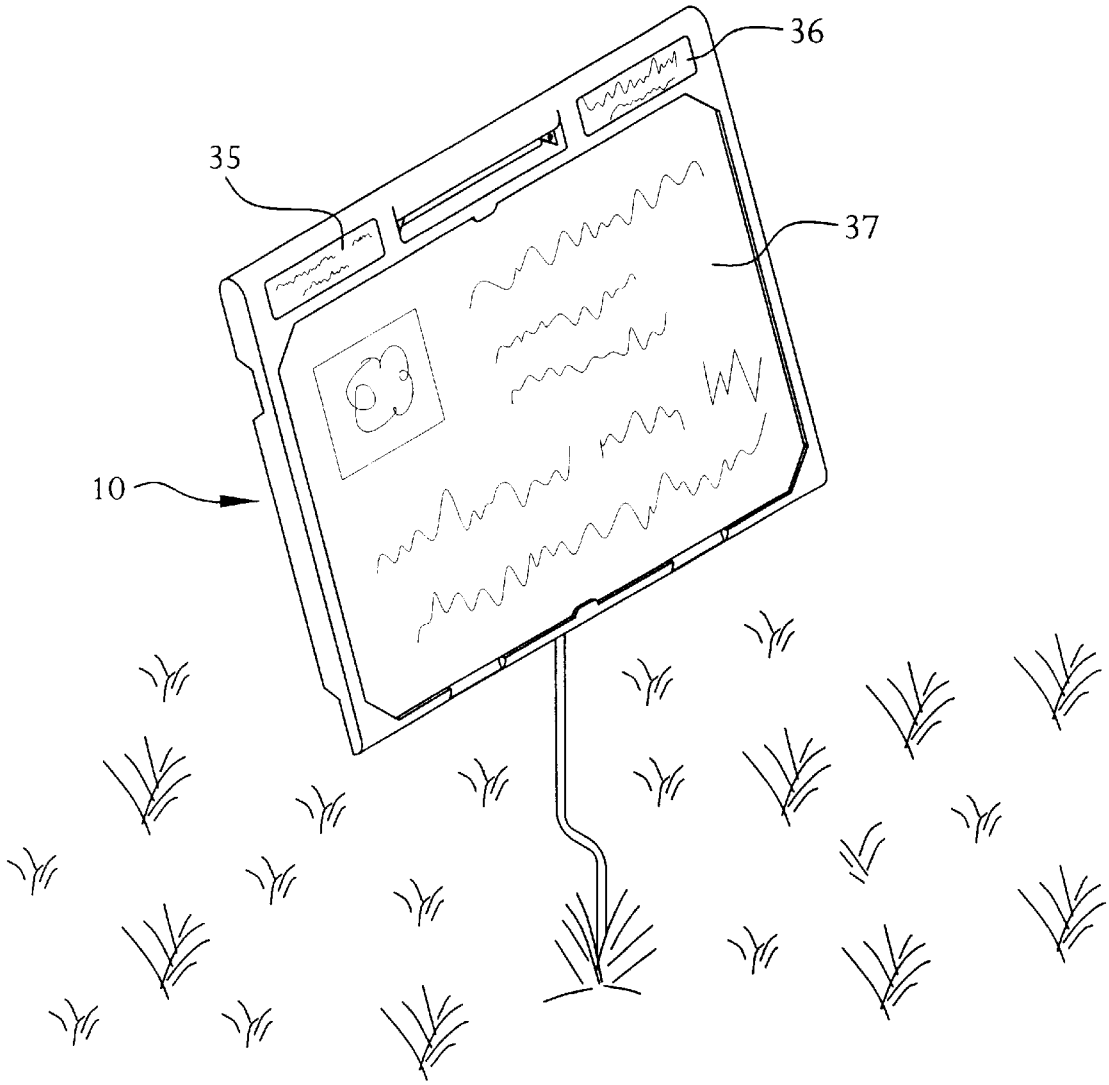
FIG. 5 is a perspective view of a sign holder of the present invention including multiple inserted signs.

FIG. 5 illustrates a sign holder anchored into the ground and including three sign inserts 35, 36 and 37. Sign insert 37 is depicted as being much larger in dimension relative to inserts 35 and 36, and may include information such as a "hole sponsor" in a golf charity event. Smaller inserts 35 and 36 may include information related to the particular golf course where the event is being played, advertisements or the like.

Figure 6:
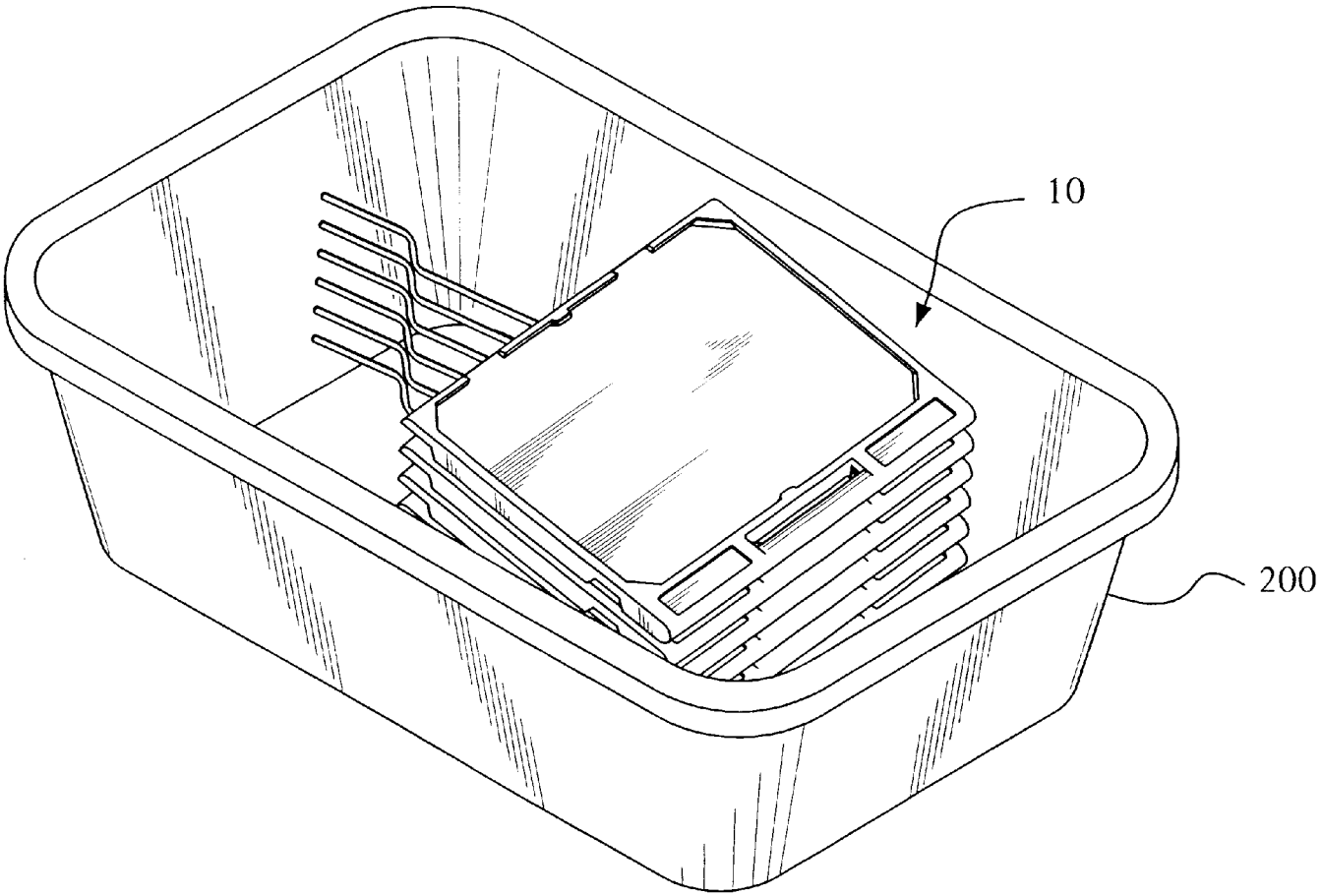
FIG. 6 is a perspective view of a signage system provided by the present invention, comprising a container holding multiple sign holders.

A signage system is also contemplated by the present invention, wherein a plurality of sign holders is employed to display a corresponding plurality of signs. The signs to be inserted into the holders can be the same, different, or a combination of similar and different signs. The signage system may optionally employ a container 200 (as shown in FIG. 6) for holding multiple sign holders. Container 200 provides an effective means for storing and transporting the sign holders. Container 200 may be made with a polyolefin resin by injection molding techniques.

An example of a sign holder provided by the present invention is provided below.

EXAMPLE 1

A substantially rectangular support member was blow molded from a green-pigmented polyolefin. The overall dimensions of the support member were 17¾" wide×13¾" high×1" deep. The front surface had three recesses, a large central recess and two smaller recesses above the large recess and on either side of the formed handle. The large recess was 11¼"×17¼". The sidewalls of the large recess were ⅛" (depth of recess). There were two-2" openings in the bottom sidewall. The two smaller recesses were 4¹⁄₁₆"× 1⅜". A ⅜" diameter steel stake was attached to a channel in the rear surface of the support member with two plastic straps utilizing two screws per strap. The steel stake was painted black and extended 16" below the bottom of the support member. The end of the stake attached to the support member was bent at an angle of 25 degrees. The right angle bend provided a projection of 2". The opposing end had a right angle bend, providing a ground insertion length, below the right angle bend, of 6". The support member accordingly stood 10" high, with the stake portion below the right angle bend driven into the ground.

It is to be understood that even though numerous characteristics and advantages of the present invention have been set forth in the foregoing description, together with details of the structure and function of the invention, the disclosure is illustrative only. Accordingly, changes may be made in detail, especially in matters of shape, size and arrangement of features within the principles of the invention to the full extent indicated by the broad general meaning of the terms in which the appended claims are expressed.

What is claimed is:

1. A sign holder, comprising:

a support member including:

a front surface and a rear surface; and at least one recess in said front surface for receiving a sign, said at least one recess having a bottom surface and sidewalls extending from said front surface to said bottom surface;

wherein said bottom surface comprises at least one aperture that is suitable for receiving peripheral portions of an inserted sign, and said front surface comprises at least one tab covering a portion of said at least one aperture.

2. The sign holder of claim 1, wherein at least one of said sidewalls comprises an opening for facilitating removal of an inserted sign.

3. The sign holder of claim 1, wherein said support member is constructed from plastic.

4. The sign holder of claim 1, wherein said support member is blow molded.

5. The sign holder of claim 1, wherein said support member includes two or more recesses for displaying two or more signs.

6. The sign holder of claim 5, wherein said support member has three recesses, at least two of which are different sizes.

7. The sign holder of claim 1 further comprising a handle extending from said support member.

8. The sign holder of claim 1 further comprising an anchorage member coupled to said support member.

9. The sign holder of claim 8, wherein said support member is angled relative to said anchorage member.

10. The sign holder of claim 8, wherein said anchorage member comprises a projection capable of receiving a normal force for driving the anchorage member.

11. The sign holder of claim 8, wherein said anchorage member is a stake.

12. The sign holder of claim 8, wherein the anchorage member is flexible, such that the sign holder is capable of flexing upon impact by a foreign object to minimize permanent damage to the sign holder.

13. A signage system for displaying signs at multiple events, comprising:

a plurality of portable and reusable sign holders, each of said sign holders including a support member having a front surface and a rear surface and at least one recess in said front surface for receiving a sign, wherein said at least one recess has a bottom surface and sidewalls extending from said front surface to said bottom surface, said bottom surface has an aperture formed therein, and said front surface has a tab overhanging at least a portion of said aperture; and a plurality of signs corresponding to a first event that are removably affixed to said plurality of reusable sign holders.

14. The signage system of claim 13 further comprising at least one container for holding said plurality of reusable sign holders.

* * * * *